US006966472B2

(12) United States Patent
Szarek

(10) Patent No.: US 6,966,472 B2
(45) Date of Patent: Nov. 22, 2005

(54) INFANT ACTIVITY NECKLACE

(76) Inventor: Karla D. Szarek, 4340 Lotus La., Coopersburg, PA (US) 18036

( * ) Notice: Subject to any disclaimer, the term of this patent is extended or adjusted under 35 U.S.C. 154(b) by 79 days.

(21) Appl. No.: 10/358,769

(22) Filed: Feb. 5, 2003

(65) Prior Publication Data

US 2004/0149795 A1 Aug. 5, 2004

(51) Int. Cl.[7] ..... A45F 3/14

(52) U.S. Cl. ..... 224/607; 224/250; 224/257; 446/28; 24/3.4

(58) Field of Search ..... 224/250, 251, 224/254, 257, 600, 607, 623; 24/3.4; 446/227, 446/28, 26

(56) References Cited

U.S. PATENT DOCUMENTS

| | | | | | |
|---|---|---|---|---|---|
| 2,327,253 | A | | 8/1943 | Eisel | |
| 3,085,610 | A | * | 4/1963 | Vardan | 446/227 |
| 3,087,277 | A | * | 4/1963 | McCook | 224/625 |
| 3,096,010 | A | | 7/1963 | Rasmussen | |
| 3,184,883 | A | * | 5/1965 | McCook | 224/250 |
| 4,498,613 | A | * | 2/1985 | Donahue et al. | 224/251 |
| 5,077,927 | A | | 1/1992 | Derryberry | |
| 5,351,346 | A | * | 10/1994 | Hodges, Jr. | 224/220 |
| 5,465,888 | A | * | 11/1995 | Owens | 224/680 |
| 5,702,039 | A | * | 12/1997 | Olaiz | 224/250 |
| 5,730,340 | A | * | 3/1998 | Bosic | 224/250 |
| 5,806,732 | A | | 9/1998 | Hensley | |
| 5,893,198 | A | | 4/1999 | DeCotis | |
| 5,950,888 | A | * | 9/1999 | Nolan-Brown | 446/227 |
| D414,602 | S | | 10/1999 | Bolen et al. | |
| D426,699 | S | * | 6/2000 | Dickerson | D3/215 |
| 6,209,134 | B1 | | 4/2001 | Schiesel | |
| 6,224,450 | B1 | * | 5/2001 | Norton | 446/28 |
| 6,442,759 | B1 | | 9/2002 | Straham, Jr. et al. | |
| 2002/0124297 | A1 | * | 9/2002 | Caris et al. | 446/227 |

OTHER PUBLICATIONS

ORVIS Publication, Spring 2002 Catalog, p. 69, Item #J32A1 Gallatin Lanyard.

* cited by examiner

*Primary Examiner*—Nathan J. Newhouse
(74) *Attorney, Agent, or Firm*—Harold I. Masteller, Jr.

(57) ABSTRACT

The present invention provides a support pad attached to a necklace device. The support pad includes tethers attached to the support pad at a spaced apart distance, and each tether includes means for attaching a toy at a location remote from the support pad. The support pad is constructed to provide rigidity sufficient to maintain the spaced apart distance between the tethers so that each attached toy is suspended from the support pad at substantially an identical angle with respect to the support pad. This prevents entanglement of the suspended toys.

12 Claims, 3 Drawing Sheets

INFANT ACTIVITY NECKLACE

FIELD OF THE INVENTION

The present invention is directed to an activity necklace for interaction between a parent, or other caregiver, and an infant, and in particular, the present invention is directed to an infant activity necklace worn by the parent, the activity necklace including a selection of different play items that are both fixed to and suspended from the activity necklace to provide interaction with an infant held on the parents lap.

BACKGROUND OF THE INVENTION

A variety of different necklace or lanyard type devices have been provided in the past to hold toys or tools. One such lanyard is disclosed in U.S. Pat. No. 5,806,732 to hold game calls. Another such device is the "Gallatin Lanyard" sold by Orvis for holding fly fishing accessories. Such lanyards of the past are problematic in that the weight of the suspended items causes the items to bunch up along or near the center of gravity when the lanyard is worn around the neck of a user. This bunching or clustering problem causes entanglement of the suspended items, making it difficult to retrieve items selected by the user. For example, we have witnessed the frustration of fly-fishing guides, wearing lanyards similar to the Orvis Gallatin Lanyard, when their entangled accessories interfered with their ability to provide quick assistance to their clients.

There have also been a number of different devices in the past that provide means for securing toys within reach of an infant. For example U.S. Pat. No. 6,442,759 B1 discloses a multi-purpose big adapted to hold a toy, and U.S. Pat. No. 5,702,039 discloses a utility belt attached to a stroller and including tethers for attaching toys or other items. Such devices of the past cannot be worn by a parent and they provide limited or no interaction between the parent and infant.

SUMMARY OF THE INVENTION

It is therefore an object of the present invention to provide an infant activity necklace suited for wear by a parent.

It is another object of the present invention to provide an infant activity necklace having a variety of play items fixed to and suspended from the activity necklace.

It is still another object of the present invention to provide an infant activity necklace where the suspended play items do not bunch up along or near the center of gravity when the activity necklace is worn.

And finally, it is another object of the present invention to provide an infant activity necklace having means to store play or other items for later use.

In satisfaction of the foregoing objects and advantages, the present invention provides an infant activity necklace comprising:

a support pad attached to a necklace device. The support pad includes tethers attached to the support pad at a spaced apart distance, and each tether includes means for attaching a toy at a location remote from the support pad. The support pad is constructed to provide rigidity sufficient to maintain the spaced apart distance between the tethers so that each attached toy is suspended from the support pad at substantially an identical angle with respect to the support pad. This prevents entanglement of the suspended toys.

BRIEF DESCRIPTION OF THE DRAWINGS

The above and other objects, advantages, and novel features of the present invention will become apparent from the following detailed description of the preferred embodiment of the invention illustrated in the accompanying drawings, wherein.

DETAILED DESCRIPTION OF THE PREFERRED EMBODIMENT

Figure 1:
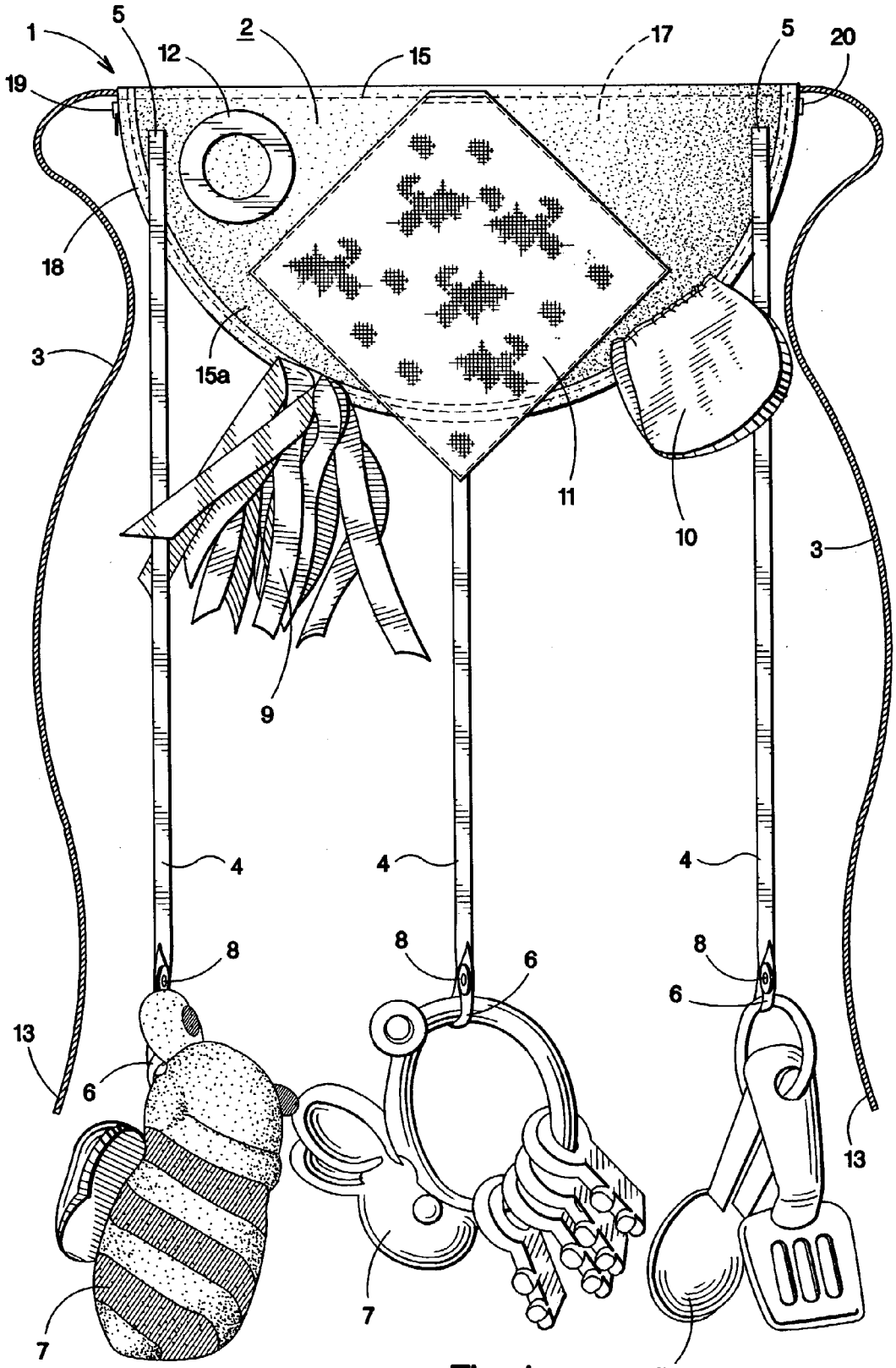
FIG. 1 is a front elevation view showing the preferred embodiment of the present invention.

The following detailed description is directed to the preferred embodiment of the present invention. Referring to FIG. 1, an infant activity necklace 1 is shown including an activity pad 2 attached to a cord 3 that is tied around a person's neck when the infant activity necklace is being used. A plurality of tethers 4, preferably elastomer cords, have one end 5 fastened to activity pad 2 and the opposite end 6 fastened to a play item or toy 7 suspended from pad 2. Tether ends 6 are attached to the suspended toys with a tied knot or with a suitable clasp or loop mechanism 8.

A second selection of play items is fixed, by sewing or other means, to activity pad 2. In the preferred embodiment the fixed play items include an assortment of colored ribbons 9, a bag or sack 10 having bells or other audio type device enclosed therein, and a peek-a-boo flap 11 that may be raised (FIG. 2) or lowered for interactive play with an infant held on a parent's lap. A third selection of play items 12 are removably attached to activity pad 2 using Velcro® of other similar hook and loop fastening means to provide free or unfettered interaction action parent and infant.

Figure 2:
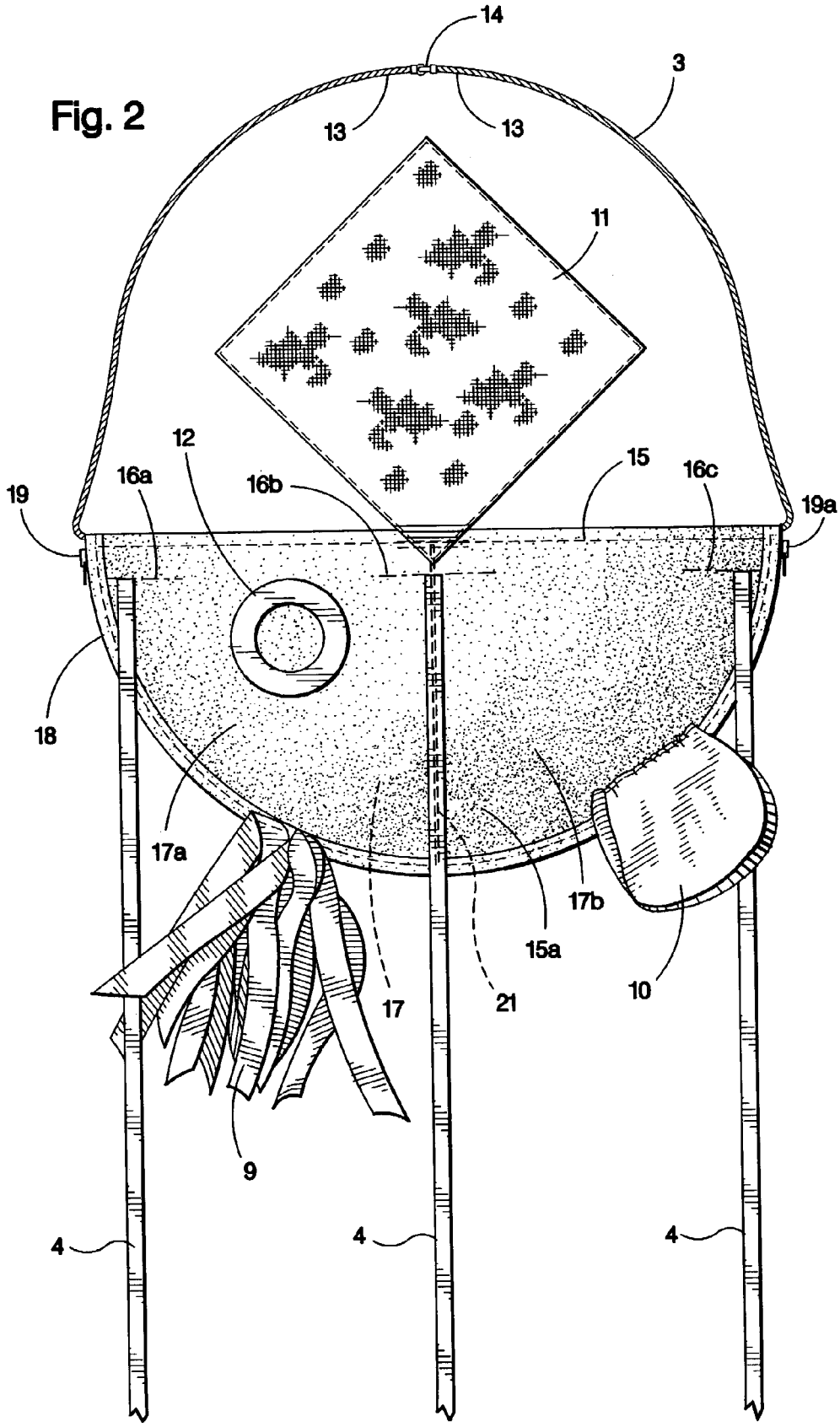
FIG. 2 is a view similar to FIG. 1.
Figure 3:
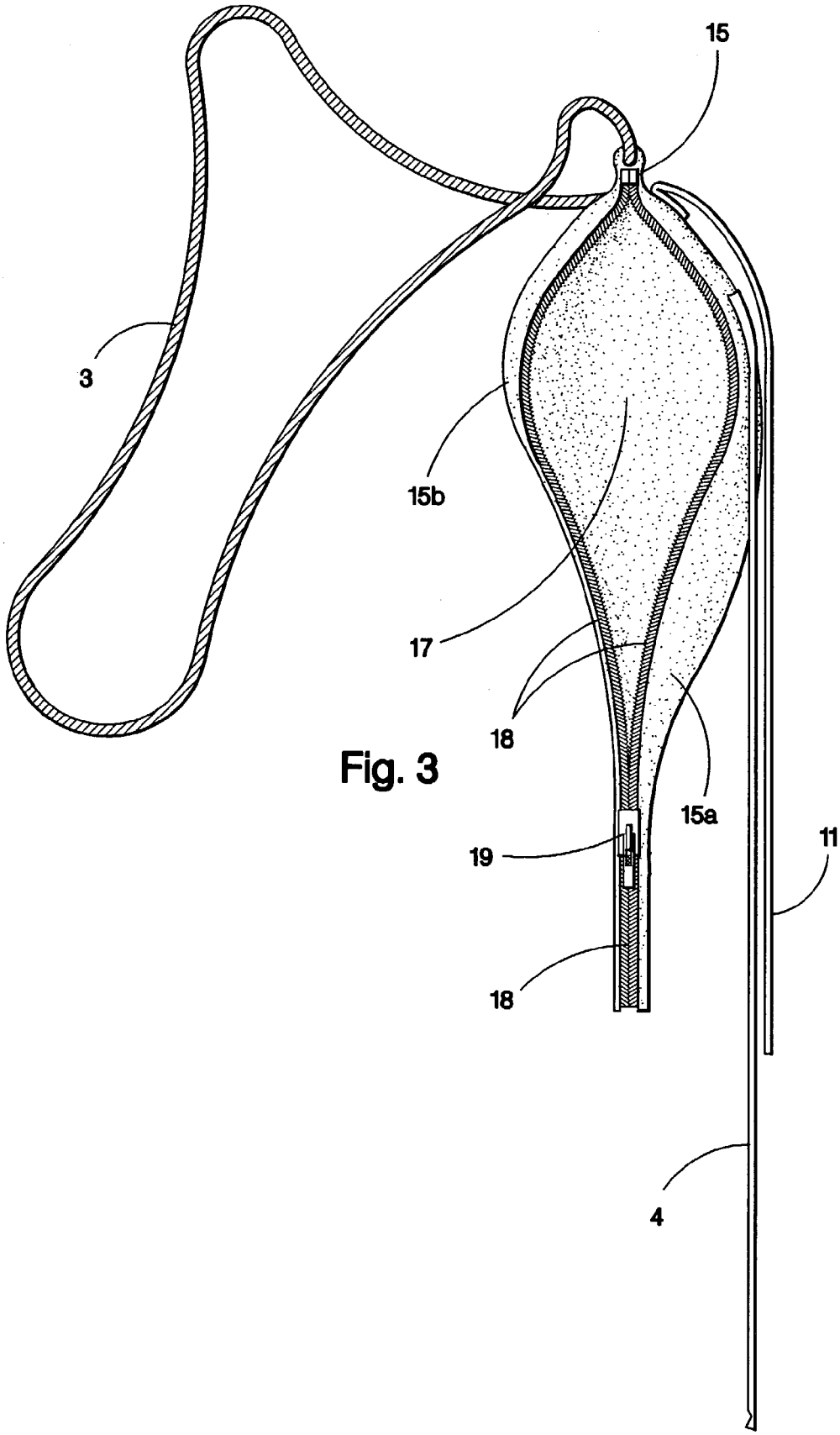
FIG. 3 is a side elevation view of the preferred embodiment shown in FIG. 1.

Cord 3 may comprise a simple single strand of cord having opposite ends 13 tied together so that necklace length is easily adjusted to user preference. Alternatively, as shown in FIG. 2, the opposite ends 13 of cord 3 may be attached using any suitable clasp 14 capable of locking a necklace, or, as shown in FIG. 3, cord 3 may comprise an endless loop that is simply slipped over a user's head.

Activity pad 2 comprises a circular blank of padded material folded into halves 15*a* and 15*b*, the pad being sewn along its folded edge 15 and the corresponding edges of both halves 15*a* and 15*b*. The doubled over and sewn material provides a firm semicircular pad having sufficient rigidity to support play items 7 without the pad collapsing under the weight of the suspended items. In the preferred embodiment shown in FIG. 2, one end of each spaced apart tether 4 is fixed to the activity pad along attachment lines 16*a* through 16*c*. When worn by a parent or other person, the rigidity provided by the pad 2 construction is able to maintain a straight line along attachment lines 16*a* through 16*c* and along folded edge 15. This enables each play item to be suspended from activity pad 2 at substantially identical angles to folded edge 15, and as a result, in bunch up and entanglement of the suspended play items, as described above in the lanyard devices of the past, is eliminated. It should be understood, however, that although FIG. 2 shows tethers 4 attachment lines 16*a* through 16*c* located at the same distance from folded edge 15, one or more of the tether attachments may be located at a different position from folded edge 15 without departing from the scope of the present invention. Additionally, activity pad 2 may comprise any suitable pad or plate like device, either folded or not folded, as long as the device has sufficient rigidity to prevent bunch up and entanglement as described above.

In the preferred embodiment, activity pad 2 includes an interior pocket 17 for receiving and storing items. For example different play items may be stored within pocket 17 so that stored play items may be exchanged with tethered play items 7. Likewise, other useful items, such as tissues, snacks, or the like, may also be stored within pocket 17. Access to interior pocket 17 is provided by a suitable zipper like mechanism 17. For example as shown in FIGS. 1 and 2, the mechanism is a zipper 18 having a single slide 19 and stop 20. Zipper 18 is sewn into both folded pad halves 15*a* and 15*b* along their circumferential edges to provide sealable access to the interior pocket 17. Referring to FIG. 2, the drawing shows zipper 18 having two slides 19 and 19*a* to provide sealable access to the interior pocket 17 along opposite ends of the activity pad 2. The pocket 17 may also include an interior panel 21 that divides the pocket into left side and right side pockets 17*a* and 17*b* respectively.

In use, it is expected that the parent will wear the infant activity necklace at an adjusted position around the wear's neck that places the activity pad in a convenient location for interaction between the parent and the infant held on the parent's lap.

As such, an invention has been disclosed in terms of preferred embodiments thereof which fulfills each and every one of the objects of the present invention as set forth above and provides new and improved means for uniformly distributing material onto treatment apparatus. Of course, various changes, modifications, and alterations from the teachings of the present invention may be contemplated by those skilled in the art without departing from the intended spirit and scope thereof. It is intended that the present invention only be limited by the terms of the appended claims.

I claim:

1. An infant activity necklace, comprising:

a) a support pad including a folded blank having;

i) a folded edge ii) a first support pad half, and iii) a second support pad half fastened to said first support pad half along corresponding edges that extend between a first end of said folded edge to a second end of said folded edge;

b) at least two tethers attached to a surface of said first support pad half at a spaced apart distance, each said tether including means to attach a toy at a location remote from said support pad;

wherein said folded edge provides support pad rigidity sufficient to maintain said spaced apart distance between said at least two tethers so that each attached toy is suspended from said support pad at substantially an identical angle to said folded edge.

2. The infant activity necklace of claim 1, comprising:

a) at least one fixed toy fastened to a surface of said first support pad half.

3. The infant activity necklace of claim 2 wherein said at least one fixed toy is an audible toy.

4. The infant activity necklace of claim 2 wherein said at least one fixed toy is a peek-a-boo flap.

5. The infant activity necklace of claim 2 wherein said at least one fixed toy is a collection of ribbons.

6. The infant activity necklace of claim 1, comprising:

a) at least one detachable toy removably fastened to a surface of said first support pad half.

7. The infant activity necklace of claim 6 wherein said at least one detachable toy is fastened using a hook and loop attachment means.

8. The infant activity necklace of claim 1 comprising:

a) an packed is provided within a space between said first support pad half and said second support pad half; and b) a zipper mechanism is fastened said corresponding edges said first support pad half and said second support pad half to provide means to seal and unseal said pocket.

9. The infant activity necklace of claim 8 wherein said pocket includes at least one interior panel that divides said pocket into multiple interior pockets.

10. The infant activity necklace of claim 8 wherein said zipper mechanism includes two zipper slides that provide means to seal and unseal said pocket along opposite ends of said support pad.

11. The infant activity necklace of claim 9 including two zipper slides to provide interior pocket access along opposite ends of said support pad.

12. The infant activity necklace of claim 1 wherein said folded blank is a circular folded blank.

* * * * *